US010457894B2

(12) United States Patent
Meier et al.

(10) Patent No.: US 10,457,894 B2
(45) Date of Patent: Oct. 29, 2019

(54) COLOR-PROTECTING DETERGENT OR CLEANING AGENT HAVING AN OPTICAL BRIGHTENER

(71) Applicant: Henkel AG & Co. KGaA, Duesseldorf (DE)

(72) Inventors: Frank Meier, Duesseldorf (DE); Sabine Schuemann, Neuss (DE); Thorsten Ott, Moenchengladbach (DE); Luca Bellomi, Duesseldorf (DE); Matthias Sunder, Duesseldorf (DE)

(73) Assignee: Henkel AG & Co. KGaA (DE)

( * ) Notice: Subject to any disclaimer, the term of this patent is extended or adjusted under 35 U.S.C. 154(b) by 0 days.

(21) Appl. No.: 14/860,802

(22) Filed: Sep. 22, 2015

(65) Prior Publication Data

US 2016/0010030 A1 Jan. 14, 2016

Related U.S. Application Data

(63) Continuation of application No. PCT/EP2014/055137, filed on Mar. 14, 2014.

(30) Foreign Application Priority Data

Mar. 22, 2013 (DE) ..... 10 2013 205 079

(51) Int. Cl.

| | |
|---|---|
| ***C11D 17/00*** | (2006.01) |
| ***C11D 3/42*** | (2006.01) |
| ***C11D 3/37*** | (2006.01) |
| ***C11D 3/00*** | (2006.01) |
| ***C11D 17/04*** | (2006.01) |
| ***C11D 3/34*** | (2006.01) |

(52) U.S. Cl.

CPC ..... *C11D 3/0021* (2013.01); *C11D 3/3418* (2013.01); *C11D 3/3776* (2013.01); *C11D 3/3792* (2013.01); *C11D 3/42* (2013.01); *C11D 17/043* (2013.01); *C11D 17/045* (2013.01)

(58) Field of Classification Search

None

See application file for complete search history.

(56) References Cited

U.S. PATENT DOCUMENTS

| | | | | |
|---|---|---|---|---|
| 2002/0077264 | A1* | 6/2002 | Roberts | B65D 75/38 510/296 |
| 2002/0077265 | A1 | 6/2002 | Buzzacarini et al. | |
| 2002/0123444 | A1* | 9/2002 | Fisher | B65D 77/04 510/297 |
| 2002/0169092 | A1* | 11/2002 | Alexandre Catlin | B65B 9/04 510/220 |
| 2003/0216274 | A1 | 11/2003 | Del Duca et al. | |
| 2004/0033921 | A1* | 2/2004 | Dasque | C11D 3/3907 510/295 |
| 2010/0144579 | A1 | 6/2010 | Volkel et al. | |
| 2011/0319311 | A1* | 12/2011 | Labeque | C11D 3/2079 510/296 |
| 2011/0319314 | A1* | 12/2011 | Labeque | C11D 3/227 510/527 |
| 2015/0203795 | A1* | 7/2015 | Miracle | C11D 3/42 510/297 |

FOREIGN PATENT DOCUMENTS

| | | | |
|---|---|---|---|
| EP | 0596185 | A1 | 5/1994 |
| WO | 2012/004134 | A1 | 1/2012 |

OTHER PUBLICATIONS

PCT International Search Report (PCT/EP2014/055137) dated Apr. 6, 2014.

* cited by examiner

*Primary Examiner* — Lorna M Douyon

(74) *Attorney, Agent, or Firm* — Thomas G. Krivulka

(57) ABSTRACT

The application describes a water-soluble packaging having at least two chambers and containing a first liquid detergent or cleaning agent with a low content of water, a second liquid detergent or cleaning agent with a low content of water and a water-soluble wrapping, the first liquid detergent or cleaning agent with a low content of water containing an optical brightener and the second liquid detergent or cleaning agent with a low content of water containing a color transfer inhibitor.

6 Claims, No Drawings

COLOR-PROTECTING DETERGENT OR CLEANING AGENT HAVING AN OPTICAL BRIGHTENER

FIELD OF THE INVENTION

The present invention generally relates to a water-soluble packaging having at least two chambers and containing a first liquid detergent or cleaning agent with a low content of water, a second liquid detergent or cleaning agent with a low content of water and a water-soluble wrapping.

BACKGROUND OF THE INVENTION

Optical brighteners (what are known as "whiteners") are added to detergents or cleaning agents in order to eliminate greying and yellowing of the treated textile fabric. These substances are drawn onto the fiber and bring about a brightening and simulated bleaching effect by converting invisible ultraviolet radiation into visible light of longer wavelength, wherein the ultraviolet light absorbed from the sunlight is irradiated as light bluish fluorescence and together with the yellow tone or the greyed or yellowed laundry gives pure white. Detergents or cleaning agents containing optical brighteners are often also referred to as universal detergents.

When washing and/or cleaning dyed textiles, in order to effectively suppress dye detachment and/or dye transfer to other textiles, a color transfer inhibitor is added to a detergent or cleaning agent. Here, the color transfer inhibitor mostly forms complexes with the dyes that have detached from the textiles and are present in the washing liquor. Detergents or cleaning agents with color transfer inhibitor are often also referred to as color detergents.

Attempts to expand the service spectrum of liquid universal detergents by the property of staining inhibition have failed due the fact that optical brighteners and color transfer inhibitors are not compatible in an aqueous detergent matrix with conventional composition. The simultaneous incorporation of an optical brightener and a polymeric color transfer inhibitor into a liquid detergent matrix leads immediately to a severe clouding and subsequent flocculation or phase separation. The instabilities occur in a particularly pronounced manner in the case of liquid detergents or cleaning agents that are concentrated or have a low content of water.

A stable aqueous detergent or cleaning agent containing an optical brightener and a color transfer inhibitor is known from WO 2009/019136 A1 and has a pH value in a narrow range from 6.5 to 7.5.

There is also a need to provide a storage-stable, liquid detergent or cleaning agent with a low content of water that contains an optical brightener and a color transfer inhibitor.

This object is achieved by a water-soluble packaging having at least two chambers and containing a first liquid detergent or cleaning agent with a low content of water, a second liquid detergent or cleaning agent with a low content of water and a water-soluble wrapping, the first liquid detergent or cleaning agent with a low content of water containing an optical brightener and the second detergent or cleaning agent with a low content of water containing a color transfer inhibitor.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A water-soluble packaging having at least two chambers and containing a first liquid detergent or cleaning agent with a low content of water, a second liquid detergent or cleaning agent with a low content of water and a water-soluble wrapping, said first liquid detergent or cleaning agent with a low content of water containing an optical brightener and said second liquid detergent or cleaning agent with a low content of water containing a color transfer inhibitor.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

It has surprisingly been found that optical brighteners and color transfer inhibitors can each be incorporated in high quantities in a stable manner into a liquid detergent or cleaning agent with a low content of water located in a water-soluble wrapping, without resulting in clouding, phase separation and/or reaction with the water-soluble wrapping. In addition, by introducing the optical brightener and the color transfer inhibitor into different chambers, an undesired reaction of the two contents with one another is prevented.

It is preferable for the optical brightener to be selected from the substance classes of distyrylbiphenyls, stilbenes, 4,4'-diamino-2,2'-stilbene disulfonic acids, coumarins, dihydroquinolinones, 1,3-diarylpyrazolines, naphthalic acid imides, benzoxazole systems, benzisoxazole systems, benzimidazole systems, heterocycle-substituted pyrene derivatives, and mixtures thereof. These substance classes of optical brighteners are highly stable, exhibit a high resistance to light and oxygen, and possess a high affinity for fibers.

The following optical brighteners, which are selected from the group consisting of disodium-4,4'-bis-(2-morpholino-4-anilino-s-triazin-6-ylamino)stilbene disulfonate, disodium-2,2'-bis-(phenyl-styryl)disulfonate, 4,4'-bis[(4-anilino-6-[bis(2-hydroxyethyl)amino]-1,3,5-triazin-2-yl) amino]stilbene-2,2'-disulfonic acid, hexasodium-2,2'[vinylene bis[(3-sulfonato-4,1-phenylene)imino[6-(diethylamino)-1,3,5-triazin-4,2-diyl]imino]]bis-(benzene-1,4-disulfonate), 2,2'-(2,5-thiophenediyl)bis[5-1,1-dim, can be easily incorporated in a stable manner into a liquid detergent or cleaning agent with a low content of water.

The color transfer inhibitor is more preferably selected from the group comprising polyvinyl pyrrolidone (PVP), polyvinyl imidazole (PVI), copolymers of vinyl pyrrolidone and vinyl imidazole (PVP/PVI), polyvinylpyridine-N oxide, poly-N-carboxymethyl-4-vinylpyridium chloride, polyethylene glycol-modified copolymers of vinyl pyrrolidone and vinyl imidazole, and mixtures thereof.

These compounds form particularly stable complexes with the dyes detached from the textiles and can also be easily incorporated in a stable manner into a liquid detergent or cleaning agent with a low content of water.

The quantity of optical brightener is preferably from 0.01 to 0.75% by weight, in relation to the total first liquid detergent or cleaning agent with a low content of water.

It is also preferred that the quantity of color transfer inhibitor is from 0.02 to 0.6% by weight, in relation to the total second liquid detergent or cleaning agent with a low content of water.

It is also preferred that the water-soluble wrapping contains polyvinyl alcohol or a polyvinyl alcohol copolymer. Water-soluble wrappings that contain polyvinyl alcohol or a polyvinyl alcohol copolymer have good stability with a sufficiently high water solubility, in particular cold-water solubility.

The invention will be explained hereinafter in greater detail on the basis of examples, inter alia.

The water-soluble wrapping comprises a first liquid detergent or cleaning agent with a low content of water, a second liquid detergent or cleaning agent with a low content of water and a water-soluble wrapping.

The first liquid detergent or cleaning agent with a low content of water and the second liquid detergent or cleaning agent with a low content of water differ from one another at least by one ingredient. The first liquid detergent or cleaning agent with a low content of water thus contains an optical brightener and is free from color transfer inhibitors. By contrast, the second liquid detergent or cleaning agent with a low content of water contains a color transfer inhibitor and is free from optical brighteners.

The optical brightener of the first liquid detergent or cleaning agent is preferably selected from the substance classes of distyrylbiphenyls, stilbenes, 4,4-diamino-2,2'-stilbene disulfonic acids, coumarins, dihydroquinolinones, 1,3-diarylpyrazolines, naphthalic acid imides, benzoxazole systems, benzisoxazole systems, benzimidazole systems, heterocycle-substituted pyrene derivatives, and mixtures thereof.

Particularly preferred optical brighteners include disodium-4,4'-bis-(2-morpholino-4-anilino-s-triazin-6-ylamino) stilbene disulfonate (for example obtainable as Tinopal® DMS from BASF SE), disodium-2,2'-bis-(phenyl-styryl) disulfonate (for example obtainable as Tinopal® CBS from BASF SE), 4,4'-bis[(4-anilino-6-[bis(2-hydroxyethyl) amino]-1,3,5-triazin-2-yl)amino]stilbene-2,2'-disulfonic acid (for example obtainable as Tinopal® UNPA from BASF SE), hexasodium-2,2'-[vinylene bis[(3-sulfonato-4,1-phenylene)imino[6-(diethylamino)-1,3,5-triazin-4,2-diyl] imino]]bis-(benzene-1,4-disulfonate) (for example obtainable as Tinopal® SPF from BASF SE), 2,2'-(2,5-thiophenediyl)bis[5-1,1-dimethylethyl)-benzoxazole (for example obtainable as Tinopal® SFP from BASF SE), and/or 2,5-bis(benzoxazol-2-yl)thiophene.

In a particularly preferred embodiment of the invention the first liquid detergent or cleaning agent with a low content of water contains disodium-4,4'-bis-(2-morpholino-4-anilino-s-triazin-6-ylamino)stilbene disulfonate and/or disodium-2,2'-bis-(phenyl-styryl)disulfonate as optical brightener.

The quantity of optical brightener may be from 0.01 to 0.75% by weight and is preferably from 0.05 to 0.5% by weight, in each case in relation to the total first liquid detergent or cleaning agent with a low content of water.

The second liquid detergent or cleaning agent with a low content of water contains a color transfer inhibitor as essential component.

The color transfer inhibitor is preferably a polymer or copolymer of cyclic amines, such as vinyl pyrrolidone and/or vinyl imidazole. As color transfer inhibitor, suitable polymers include polyvinyl pyrrolidone (PVP), polyvinylimidazole (PVI), copolymers of vinyl pyrrolidone and vinyl imidazole (PVP/PVI), polyvinylpyridine-N-oxide, poly-N-carboxymethyl-4-vinylpyridium chloride, polyethylene glycol-modified copolymers of vinyl pyrrolidone and vinyl imidazole, and mixtures thereof. Polyvinyl pyrrolidone (PVP), polyvinylimidazole (PVI) or copolymers of vinyl pyrrolidone and vinyl imidazole (PVP/PVI) are particularly preferably used as color transfer inhibitor. The used polyvinyl pyrrolidones (PVP) preferably have an average molecular weight from 2,500 to 400,000, and are commercially available from ISP Chemicals as PVP K 15, PVP K 30, PVP K 60 or PVP K 90, or from BASF as Sokalan® HP 50 or Sokalan® HP 53. The used copolymers of vinyl pyrrolidone and vinyl imidazole (PVP/PVI) preferably have a molecular weight in the range from 5,000 to 100,000. A PVP/PVI copolymer is commercially available by way of example from BASF under the name Sokalan® HP 56. A further color transfer inhibitor that can be used in an extremely preferred manner is provided by polyethylene glycol-modified copolymers of vinyl pyrrolidone and vinyl imidazole, which for example are obtainable under the name Sokalan® HP 66 from BASF.

The quantity of color transfer inhibitor in relation to the total quantity of the detergent or cleaning agent lies preferably from 0.02 to 0.6% by weight and preferably from 0.1 to 0.4% by weight, in each case in relation to the total second liquid detergent or cleaning agent with a low content of water.

Besides the optical brightener or the color transfer inhibitor, the first liquid detergent or cleaning agent with a low content of water and the second liquid detergent or cleaning agent with a low content of water each contain a surfactant, which for example may be an anionic surfactant, a non-ionic surfactant, a zwitterionic surfactant, a cationic surfactant, or a mixture thereof. The first liquid detergent or cleaning agent with a low content of water and/or the second liquid detergent or cleaning agent with a low content of water preferably contain anionic and non-ionic surfactant.

Sulfonates and/or sulfates can be used preferably as anionic surfactant. The content of anionic surfactant is 5 to 25% by weight and preferably 8 to 20% by weight, in each case in relation to the total first or second liquid detergent or cleaning agent with a low content of water.

Here, $C_9$-$C_{13}$ alkylbenzene sulfonates, olefin sulfonates, i.e. mixtures of alkene and hydroxyalkane sulfonates and also disulfonates, as are obtained for example from $C_{12}$-$C_{18}$ monoolefins having a terminal or internal double bond by sulfonation with gaseous sulfur trioxide and subsequent alkaline or acidic hydrolysis of the sulfonation products, are considered preferably as surfactants of the sulfonate type. $C_{12}$-$C_{18}$ alkane sulfonates and the esters of α-sulfofatty acids (ester sulfonates), for example the α-sulfonated methyl esters of hydrogenated coconut fatty acids, palm kernel fatty acids or tallow fatty acids, are also suitable.

Preferred alk(en)yl sulfates are the alkali salts, and especially sodium salts of the sulfuric acid half-esters of $C_{12}$-$C_{18}$ fatty alcohols, for example from coconut fatty alcohol, tallow fatty alcohol, lauryl, myristyl, cetyl or stearyl alcohol, or of the $C_{10}$-$C_{20}$ oxo alcohols and those half-esters of secondary alcohols of these chain lengths. $C_{12}$-$C_{16}$ alkyl sulfates and $C_{12}$-$C_{15}$ alkyl sulfates and $C_{14}$-$C_{15}$ alkyl sulfates are preferred from a washing viewpoint. 2,3-alkyl sulfates are also suitable anionic surfactants.

Fatty alcohol ether sulfates, such as sulfuric acid monoesters of straight-chained or branched $C_{7-21}$ alcohols ethoxylated with 1 to 6 mol of ethylene oxide, such as 2-methyl-branched $C_{9-11}$ alcohols with an average of 3.5 mol of ethylene oxide (EO) or $C_{12-18}$ fatty alcohols with 1 to 4 EO, are also suitable.

Other suitable anionic surfactants are soaps. Saturated and unsaturated fatty acid soaps, such as the salts of lauric acid, myristic acid, palmitic acid, stearic acid, (hydrogenated) erucic acid and behenic acid and also particularly soap mixtures derived from natural fatty acids, for example coconut fatty acids, palm kernel fatty acids, olive oil fatty acids or tallow fatty acids, are suitable.

The anionic surfactants and also the soaps can be present in the form of their sodium, potassium or magnesium or ammonium salts. The anionic surfactants are preferably present in the form of their ammonium salts. Preferred counterions for the anionic surfactants are the protonated forms of choline, triethylamine, monoethanolamine or methylethylamine.

In an even more particularly preferred embodiment the first liquid detergent or cleaning agent with a low content of water and/or the second liquid detergent or cleaning agent with a low content of water each contain an alkylbenzene sulfonic acid neutralized with monoethanolamine, in particular $C_{9-13}$ alkylbenzene sulfonic acid, and/or a fatty acid neutralized with monoethanolamine.

Suitable non-ionic surfactants include alkoxylated fatty alcohols, alkoxylated fatty acid alkyl esters, fatty acid amides, alkoxylated fatty acid amides, polyhydroxy fatty acid amides, alkylphenol polyglycol ethers, amine oxides, alkyl polyglucosides, and mixtures thereof.

Alkoxylated, advantageously ethoxylated, particularly primary alcohols preferably containing 8 to 18 carbon atoms and an average of 4 to 12 mol of ethylene oxide (EO) per mol of alcohol are preferably used as non-ionic surfactant, in which alcohols the alcohol group may be linear or, preferably, methyl-branched in the 2-position, or may contain, for example, linear and methyl-branched groups in mixture, as typically present in oxo alcohol groups. In particular, however, alcohol ethoxylates with linear alcohol groups of natural origin with 12 to 18 carbon atoms, for example from coconut alcohol, palm alcohol, tallow fatty alcohol or oleyl alcohol, and an average of 5 to 8 EO per mol of alcohol are preferred. For example, the preferred ethoxylated alcohols include $C_{12-14}$ alcohols with 4 EO or 7 EO, $C_{9-11}$ alcohol with 7 EO, $C_{13-15}$ alcohols with 5 EO, 7 EO or 8 EO, $C_{12-18}$ alcohols with 5 EO or 7 EO, and mixtures thereof. The specified degrees of ethoxylation constitute statistically average values that can be a whole or a fractional number for a specific product. Preferred alcohol ethoxylates have a narrowed homologue distribution (narrow range ethoxylates, or NRE). In addition to these non-ionic surfactants, fatty alcohols with more than 12 EO can also be used. Examples include tallow fatty alcohol with 14 EU, 25 EO, 30 EO or 40 EO. Also, non-ionic surfactants containing EO groups and PO groups together in the molecule can be used in accordance with the invention. A mixture of a (more heavily) branched ethoxylated fatty alcohol and an unbranched ethoxylated fatty alcohol, such as a mixture of a $C_{16-18}$ fatty alcohol with 7 EO and 2-propylheptanol with 7 EO, is also suitable. In particular, the first liquid detergent or cleaning agent with a low content of water and/or the second liquid detergent or cleaning agent with a low content of water preferably contain a $C_{12-18}$ fatty alcohol with 7 EO, a $C_{13-15}$ oxo alcohol with 7 EO, and/or a $C_{13-15}$ oxo alcohol with 8 EO as non-ionic surfactant.

The content of non-ionic surfactant is 1 to 25% by weight and preferably 2 to 20% by weight, in each case in relation to the total first or second liquid detergent or cleaning agent with a low content of water.

The total quantity of anionic and non-ionic surfactant in the first or second liquid detergent or cleaning agent is preferably up to 85% by weight, preferably 40 to 75% by weight, and particularly preferably 50 to 70% by weight, in each case in relation to the total first or second liquid detergent or cleaning agent with a low content of water.

In addition to the optical brightener and the surfactant(s), the first liquid detergent or cleaning agent with a low content of water may contain further ingredients that further improve the application-related and/or aesthetical properties of the first liquid detergent or cleaning agent. Within the scope of the present invention, the detergent or cleaning agent preferably additionally contains one or more substances from the group of builders, bleaching agents, enzymes, electrolytes, pH adjustors, perfumes, perfume carriers, fluorescence agents, dyes, hydrotropes, foam inhibitors, silicone oils, anti-redeposition agents, anti-greying agents, shrinkage inhibitors, anti-crease agents, antimicrobial active ingredients, non-aqueous solvents, germicides, fungicides, antioxidants, preservatives, corrosion inhibitors, antistatic agents, bittering agents, ironing aids, repellants and impregnating agents, skincare active ingredients, swelling and antislip agents, softening components and UV absorbers.

In addition to the color transfer inhibitor and the surfactant(s), the second liquid detergent or cleaning agent with a low content of water may contain further ingredients that further improve the application-related and/or aesthetical properties of the first liquid detergent or cleaning agent. Within the scope of the present invention, the detergent or cleaning agent preferably additionally contains one or more substances from the group of builders, bleaching agents, enzymes, electrolytes, pH adjustors, perfumes, perfume carriers, fluorescence agents, dyes, hydrotropes, foam inhibitors, silicone oils, anti-redeposition agents, anti-greying agents, shrinkage inhibitors, anti-crease agents, antimicrobial active ingredients, non-aqueous solvents, germicides, fungicides, antioxidants, preservatives, corrosion inhibitors, antistatic agents, bittering agents, ironing aids, repellants and impregnating agents, skincare active ingredients, swelling and antislip agents, softening components and UV absorbers.

The first and second detergent or cleaning agents contained in the water-soluble wrapping are liquid. The first and the second detergent or cleaning agent have a low content of water and may contain water, the content of water being less than 15% by weight, preferably less than 10% by weight, and particularly preferably less than 8% by weight, in each case in relation to the total first and/or second liquid detergent or cleaning agent.

The water-soluble packaging, besides the first and the second liquid detergent or cleaning agent with a low content of water, also contains a water-soluble wrapping. The water-soluble wrapping is preferably formed by a water-soluble film material.

Such water-soluble packagings can be produced either by vertical form fill sealing (VVFS) methods, or by heat-forming methods.

The heat-forming method generally includes the forming of a first layer from a water-soluble film material in order to form at least convexities for receiving the liquid detergent or cleaning agent, filling the liquid detergent or cleaning agent into the convexities, covering the convexities filled with the composition with a second layer made of a water-soluble film material, and sealing the first and second layers to one another, at least around the convexities.

The water-soluble wrapping is preferably formed from a water-soluble film material selected from the group consisting of polymers or polymer mixtures. The wrapping can be formed from one or from two or more layers made of the water-soluble film material. The water-soluble film material of the first layer and of the further layers, if present, can be the same or different.

The water-soluble wrapping preferably contains polyvinyl alcohol or a polyvinyl alcohol copolymer.

Suitable water-soluble films for producing the water-soluble wrapping are preferably based on a polyvinyl alcohol or a polyvinyl alcohol copolymer of which the molecular weight lies in the range from 10,000 to 1,000,000 $gmol^{-1}$, preferably from 20,000 to 500,000 $gmol^{-1}$, particularly preferably from 30,000 to 100,000 $gmol^{-1}$, and in particular from 40,000 to 80,000 $gmol^{-1}$.

Polyvinyl alcohol is usually produced by hydrolysis of polyvinyl acetate, since the direct synthesis path is not possible. The same is true for polyvinyl alcohol copolymers, which are produced accordingly from polyvinyl acetate copolymers. It is preferred when at least one layer of the water-soluble wrapping comprises a polyvinyl alcohol of which the degree of hydrolysis accounts for 70 to 100 mol %, preferably 80 to 90 mol %, particularly preferably 81 to 89 mol %, and in particular 82 to 88 mol %.

A polymer selected from the group comprising acrylic acid-containing polymers, polyacrylamides, oxazoline polymers, polystyrene sulfonates, polyurethanes, polyesters, polyethers, polylactic acid, and/or mixtures of the above polymers may additionally be added to a film material suitable for producing the water-soluble wrapping.

Besides vinyl alcohol, preferred polyvinyl alcohol copolymers also comprise dicarboxylic acids as further monomers. Suitable dicarboxylic acids are itaconic acid, malonic acid, succinic acid, and mixtures thereof, wherein itaconic acid is preferred.

Besides vinyl alcohol, polyvinyl alcohol copolymers that are likewise preferred also comprise an ethylenically unsaturated carboxylic acid, the salt thereof or the ester thereof. Besides vinyl alcohol, such polyvinyl alcohol copolymers particularly preferably contain acrylic acid, methacrylic acid, acrylic acid ester, methacrylic acid ester, or mixtures thereof.

Suitable water-soluble films for use in the wrappings of the water-soluble packagings according to the invention are films that are marketed by the company MonoSol LLC under the name Monosol M8630. Other suitable films include films with the name Solublon® PT, Solublon® KA, Solublon® KC or Solublon® KL from Aicello Chemical Europe GmbH or the films VF-HP from Kuraray.

The water-soluble packaging has at least two chambers. The first chamber of the water-soluble packaging contains the first liquid detergent or cleaning agent with a low content of water and the second chamber contains the second liquid detergent or cleaning agent with a low content of water. If the water-soluble packaging has more than two chambers, a solid or a further liquid detergent or cleaning agent with a low content of water can be contained in the third and the further chambers, if provided. The further liquid detergent or cleaning agent with a low content of water may have the same composition as the first liquid detergent or cleaning agent with a low content of water or the second liquid detergent or cleaning agent with a low content of water. The further liquid detergent or cleaning agent with a low content of water preferably has a composition that differs from the first liquid detergent or cleaning agent and the second liquid detergent or cleaning agent at least in terms of one ingredient or at least in terms of the content of an ingredient Since suspensions with solid and liquid ingredients are often considered by the user of the water-soluble packaging to be less aesthetically pleasing and/or defective, in the case that a third or further chamber of the water-soluble packaging has a solid detergent or cleaning agent, the solid or insoluble ingredients can be contained in one of these chambers of the water-soluble packaging.

EXAMPLES

Example 1

Liquid detergent or cleaning agents with a low content of water were produced by means of conventional and known methods and processes. The compositions of a first detergent or cleaning agent E1 according to the invention, a second detergent or cleaning agent E2 according to the invention, and three detergents or cleaning agents not according to the invention V1 to V3 are shown in table 1 below.

TABLE 1

Liquid detergents or cleaning agents E1 and E2 and also V1 to V3 [all quantities are specified in % by weight active substance, in relation to the respective composition]

| Ingredients | E1 | E2 | V1 | V2 | V3 |
|---|---|---|---|---|---|
| $C_{10}$-$C_{13}$ alkylbenzene sulfonic acid | 20.0 | 20.0 | 20.0 | 20.0 | 20.0 |
| $C_{13}$-$C_{15}$ oxo alcohol with 8 EO | 18.0 | 18.0 | 18.0 | 18.0 | 18.0 |
| $C_{12-18}$ fatty acid | 12.0 | 12.0 | 12.0 | 12.0 | 12.0 |
| Glycerol | 22.0 | 22.0 | 22.0 | 22.0 | 22.0 |
| 1,2-propanediol | 10.8 | 7.7 | 8.5 | 8.7 | 8.6 |
| Optical brightener* | 0.42 | — | 0.14 | 0.14 | — |
| Color transfer inhibitor** | — | 0.3 | 0.2 | — | 0.2 |
| Ethanol | 2.0 | 2.0 | 2.0 | 2.0 | 2.0 |
| Phosphonate | 0.7 | 0.7 | 0.7 | 0.7 | 0.7 |
| Monoethanolamine | 7.0 | 7.0 | 7.0 | 7.0 | 7.0 |
| Citric acid | 2.3 | 2.3 | 2.3 | 2.3 | 2.3 |
| Dyes, enzymes, perfume | 2.5 | 5.0 | 4.2 | 4.2 | 4.2 |
| Water | to 100 | to 100 | to 100 | to 100 | to 100 |

*disodium-2,2'-bis-(phenyl-styryl)disulfonate (Tinopal ® CBS ex BASF SE)

**copolymers of vinyl pyrrolidone and vinyl imidazole (PVP/PVI) (Sokalan ® HP 56 ex BASF)

In the case of the liquid detergent or cleaning agent V1, precipitates were observed already during production, whereas the liquid detergents or cleaning agents E1, E2, V2 and V3 were clear and storage-stable over a number of weeks.

In order to produce a water-soluble packaging with the detergents or cleaning agents E1 and E2, a film of type M 8630 (ex Monosol) with a thickness of 76 μm was drawn into a mold by means of vacuum in order to form two convexities of different size. The first convexity was then filled with 11.7 g of the first liquid detergent or cleaning agent E1. In parallel, the second convexity was filled with 23.3 g of the second liquid detergent or cleaning agent E2. After covering the convexities filled with the detergents with a second layer of a film of type M 8630, the first and second layer were sealed to one another. The sealing temperature was 150° C. and the sealing period lasted 1.1 seconds.

In order to produce a water-soluble packaging with the detergent or cleaning agent V1, V2 or V3, a film of type M 8630 (ex Monosol) with a thickness of 76 μm was drawn into a mold by means of vacuum in order to form a convexity. The convexity was then filled with 35 g of the liquid detergent or cleaning agent V1, V2 or V3. After covering the convexity filled with the detergent V1, V2 or V3 with a second layer of a film of type M 8630, the first and second layer were sealed to one another. The sealing temperature was 150° C. and the sealing period lasted 1.1 seconds.

The water-soluble packaging with the detergent or cleaning agent V1 was less aesthetically pleasing, since the precipitates formed during the production of the detergent or cleaning agent V1 settled on the water-soluble wrapping.

After 8 weeks storage time of the water-soluble packaging with the detergents or cleaning agents E1 and E2 no detachment or dissolution of the water-soluble wrapping could be observed. In addition, no pores or holes, which would also lead to product escape or leakage, could be determined. Furthermore, no reactions of the optical brightener or of the color transfer inhibitor with the water-soluble wrapping could be determined.

In order to determine the color transfer inhibition, fabrics made of cotton and polyamide were washed, in each case with a water-soluble packaging containing 35 g of the detergents or cleaning agents E1 and E2 or V3 in a domestic washing machine (Miele W 526) at 60° C. in the presence of fabrics dyed using C.I. Direct Orange 39, C.I. Direct Black 22, C.I. Direct Red 83:1 and C.I. Acid Blue 113. Following drying by hanging and then mangling of the laundry, the staining was assessed visually (see table 2) by six trained individuals by means of the SSR scale (staining scale rating).

TABLE 2

SSR values (mean values of the assessment by six test individuals)

| | SSR values of the fabrics treated with the water-soluble packagings | |
|---|---|---|
| | E1 and E2 | V3 |
| Cotton | | |
| C.I. Direct Orange 39 | 1.9 | 2.1 |
| C.I. Direct Black 22 | 4.4 | 4.2 |
| C.I. Direct Red 83:1 | 4.1 | 4.0 |
| C.I. Acid Blue 113 | 4.7 | 4.6 |
| Polyamide | | |
| C.I. Direct Orange 39 | 2.4 | 2.5 |
| C.I. Direct Black 22 | 4.3 | 4.3 |
| C.I. Direct Red 83:1 | 4.9 | 4.9 |
| C.I. Acid Blue 113 | 2.0 | 2.0 |

1 = strong staining

5 = no staining

In order to determine the white grade preservation, test fabrics made of cotton and polyamide were washed five times in succession in the presence of 3.5 kg of ballast load of cotton, in each case with a water-soluble packaging containing 35 g of the detergents or cleaning agents E1 and E2, V2 or V3 in a domestic washing machine (Miele W 1514) at 40° C., with in each case 5 SBL 2004 cloths with standardized soil load (32 g soil ballast) and a cotton cloth, which was loaded with synthetic domestic grease and grime (soil load: 2 g).

Following drying by hanging and then mangling of the laundry, the white grade of the test fabric was determined spectrophotometrically (Spectraflash SF 600 from Datacolor).

TABLE 3

Y-values (average from 4 measurement points per fabric)

| Water-soluble packaging with detergent or cleaning agent | Y-values | |
|---|---|---|
| | Cotton | Polyamide |
| E1 and E2 | 134.6 | 153.2 |
| V2 | 139 | 153 |
| V3 | 61.8 | 75.7 |

The results relating to color transfer inhibition and relating to the preservation of the white grade clearly show that, by use of a water-soluble packaging having at least two chambers and containing a first liquid detergent or cleaning agent with a low content of water comprising an optical brightener and a second liquid detergent or cleaning agent with low content of water comprising a color transfer inhibitor in separate chambers, the advantages of a universal detergent (preservation of the white grade) and of a color detergent (color transfer inhibition) can be combined in one product. The results also show that, following the escape of the two liquid detergents or cleaning agents E1 and E2 from the respective chambers into the washing liquor, there is not deactivation caused by the formation of precipitates.

Example 2

TABLE 4

Liquid detergents or cleaning agents E3 and E4 and also E5 to E6 [all quantities are specified in % by weight active substance, in relation to the respective composition]

| Ingredients | E3 | E4 | E5 | E6 |
|---|---|---|---|---|
| $C_{10}$-$C_{13}$ alkylbenzene sulfonic acid | 18.0 | 17.0 | 27.0 | 26.0 |
| $C_{13}$-$C_{15}$ oxo alcohol with 8 EU | 22.0 | 22.0 | 27.0 | 27.0 |
| $C_{12-18}$ fatty acid | 15.0 | 14.0 | 9.0 | 8.0 |
| Glycerol | 14.9 | 20.0 | 5.0 | 9.0 |
| 1,2-propanediol | 7.7 | 7.7 | 7.0 | 7.0 |
| Optical brightener* | — | 0.4 | — | 0.6 |
| Color transfer inhibitor** | 0.2 | — | 0.3 | — |
| Ethanol | 2.0 | 2.0 | 2.0 | 2.0 |
| Phosphonate | 1.0 | 1.0 | 1.5 | 1.5 |
| Monoethanolamine | 7.0 | 6.4 | 7.4 | 7.0 |
| Polyethylene amine ethoxylate*** | 1.0 | 1.0 | 4.0 | 4.0 |
| Anti-redeposition polymer**** | 1.0 | 1.0 | — | — |
| Dyes, enzymes, perfume | 5.0 | 2.5 | 5.0 | 3.5 |
| Water | to 100 | to 100 | to 100 | to 100 |

*disodium-2,2'-bis-(phenyl-styryl)disulfonate (Tinopal ® CBS ex BASF SE)

**copolymers of vinyl pyrrolidone and vinyl imidazole (PVP/PVI) (Sokalan ® HP 56 ex BASF)

***polymer (polyethylene amine core with ethylene oxide units) (Sokalan ® HP 20 ex BASF)

****polymer (polypropylene terephthalate) (Texcare ® SRN 170 ex Clariant)

The liquid detergents or cleaning agents E3, E4, E5 and E6 are clear and remain storage-stable over a number of weeks.

In order to produce a water-soluble packaging with the detergents or cleaning agents E3 and E4, a film of type M 8630 (ex Monosol) with a thickness of 76 μm was drawn into a mold by means of vacuum in order to form two convexities of different size. The first convexity was then filled with 11.7 g of the first liquid detergent or cleaning agent E3. In parallel, the second convexity was filled with 23.3 g of the second liquid detergent or cleaning agent E4. After covering the convexities filled with the detergents with a second layer of a film of type M 8630, the first and second layer were sealed to one another. The sealing temperature was 150° C. and the sealing period lasted 1.1 seconds.

In order to produce a water-soluble packaging with the detergents or cleaning agents E5 and E6, a film of type M 8630 (ex Monosol) with a thickness of 76 μm was drawn into a mold by means of vacuum in order to form two convexities of different size. The first convexity was then filled with 8.5 g of the first liquid detergent or cleaning agent E5. In parallel, the second convexity was filled with 16.5 g of the second liquid detergent or cleaning agent E6. After covering the convexities filled with the detergents with a second layer of a film of type M 8630, the first and second layer were sealed to one another. The sealing temperature was 150° C. and the sealing period lasted 1.1 seconds While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A water-soluble packaging having at least two chambers and containing a first liquid detergent or cleaning agent with a low content of water, a second liquid detergent or cleaning agent with a low content of water and a water-soluble wrapping, said first liquid detergent or cleaning agent with a low content of water containing an optical brightener and said second liquid detergent or cleaning agent with a low content of water containing a color transfer inhibitor, wherein low content of water is less than 15% by weight in each case in relation to the total first and/or second liquid detergent or cleaning agent; and wherein the first liquid detergent or cleaning agent is free from color transfer inhibitors and the second liquid detergent or cleaning agent is free from optical brighteners.

2. The water-soluble packaging as claimed in claim 1, wherein the optical brightener is selected from the group consisting of disodium-4,4'-bis-(2-morpholino-4-anilino-s-triazin-6-ylamino)stilbene disulfonate, disodium-2,2'-bis-(phenyl-styryl)disulfonate, 4,4'-bis[(4-anilino-6-[bis(2-hydroxyethyl)amino]-1,3,5-triazin-2-yl)amino]stilbene-2,2'-disulfonic acid, hexasodium-2,2'-[vinylene bis[(3-sulfonato-4,1-phenylene)imino[6-(diethylamino)-1,3,5-triazin-4,2-diyl]imino]]bis-(benzene-1,4-disulfonate), 2,2'-(2,5-thiophenediyl)bis[5-1,1-dimethylethyl)-benzoxazole, 2,5-bis(benzoxazol-2-yl)thiophene, and mixtures thereof.

3. The water-soluble packaging as claimed in claim 1, wherein the color transfer inhibitor is selected from the group consisting of polyvinyl pyrrolidone (PVP), polyvinylimidazole (PVI), copolymers of vinyl pyrrolidone and vinyl imidazole (PVP/PVI), polyvinylpyridine-N oxide, poly-N-carboxymethyl-4-vinylpyridium chloride, polyethylene glycol-modified copolymers of vinyl pyrrolidone and vinyl imidazole, and mixtures thereof.

4. The water-soluble packaging as claimed in claim 1, wherein the quantity of optical brightener is from 0.01 to 0.75% by weight, in relation to the total first liquid detergent or cleaning agent with a low content of water.

5. The water-soluble packaging as claimed in claim 1, wherein the quantity of color transfer inhibitor is from 0.02 to 0.6% by weight, in relation to the total second liquid detergent or cleaning agent with a low content of water.

6. The water-soluble packaging as claimed in claim 1, wherein the water-soluble wrapping contains polyvinyl alcohol or a polyvinyl alcohol copolymer.

* * * * *